United States Patent [19]

Evans et al.

[11] 4,445,608

[45] May 1, 1984

[54] BUCKET WHEELS AND BUCKET WHEEL RECLAIMERS

[75] Inventors: David A. Evans; Paul J. Dowden, both of Bristol, England

[73] Assignee: DRG (UK) Limited, Bristol, England

[21] Appl. No.: 285,331

[22] Filed: Jul. 22, 1981

[30] Foreign Application Priority Data

Jul. 22, 1980 [GB] United Kingdom ..... 8023945

[51] Int. Cl.[3] ..... B65G 17/36

[52] U.S. Cl. ..... 198/509; 37/70

[58] Field of Search ..... 198/307, 509, 706; 37/189, 190, 191, 70, 91–96, 118 R

[56] References Cited

U.S. PATENT DOCUMENTS

| | | | |
|---|---|---|---|
| 3,412,491 | 11/1968 | Raabe et al. | 37/189 |
| 4,009,531 | 3/1977 | Metrier | 198/509 |
| 4,057,139 | 11/1977 | Mausolf et al. | 37/189 |

*Primary Examiner*—Joseph E. Valenza
*Assistant Examiner*—Dennis J. Williamson
*Attorney, Agent, or Firm*—Cushman, Darby & Cushman

[57] ABSTRACT

A bucket wheel for a bucket wheel unloader has a series of buckets mounted on pivots around its periphery so that the buckets can be displaced between opposite end positions to correspond with either direction of rotation of the wheel. Latching means engage the buckets to retain them in their required end positions and operate automatically when the direction of rotation of the wheel is reversed.

11 Claims, 4 Drawing Figures

30
32
24
34b
34a
40

BUCKET WHEELS AND BUCKET WHEEL RECLAIMERS

BACKGROUND OF THE INVENTION

This invention relates to bucket wheels for material handling, e.g. for reclaiming material from stockpiles.

Bucket wheel reclaimers are known having a conveyor belt fed by a bucket wheel that rotates about an axis parallel to the conveyor and that has the conveyor projecting through its central region. As the bucket wheel rotates it is progressed along the length of the conveyor and so takes material from across the width of the stockpile. After each traversal of the bucket wheel across the stockpile, the reclaimer is advanced and the process is repeated, until the end of the stockpile has been reached.

The buckets are operative only in one direction of rotation because they gather the material by scooping it up. When the end of the stockpile is reached, it is often arranged that the reclaimer is moved by a transfer machine to a fresh stockpile while the stockpile on the original location is rebuilt. In order to rebuild the stockpile behind the reclaimer as it advances and then reverse the reclaimer to draw on the fresh material built up, it has been known to provide the bucket wheels of such reclaimers with manually releasable fastenings, so that an operator can readjust the individual buckets when the wheel rotation is to be reversed, but that is a time-consuming and unpleasant task.

SUMMARY OF THE INVENTION

According to one aspect of the present invention there is provided a bucket wheel having a series of buckets arranged around its periphery, each bucket being pivotally mounted to be able to move between opposite end positions in which it faces in respective opposite directions peripherally of the wheel, there being latching means for retaining the buckets in each end position and said latching means being operable to retain the buckets in one of said end positions or the other dependent upon the direction of rotation of the wheel.

According to another aspect of the invention there is provided a bucket wheel reclaimer comprising a bucket wheel that is mounted to be progressed along the length of a conveyor that extends through the central region of the wheel, and that has pivotable buckets as aforesaid so as to be able to rotate in either direction about the conveyor.

One embodiment of the invention will be described by way of example with reference to the accompanying schematic drawings, in which:

DESCRIPTION OF THE PREFERRED EMBODIMENT

Figure 1:
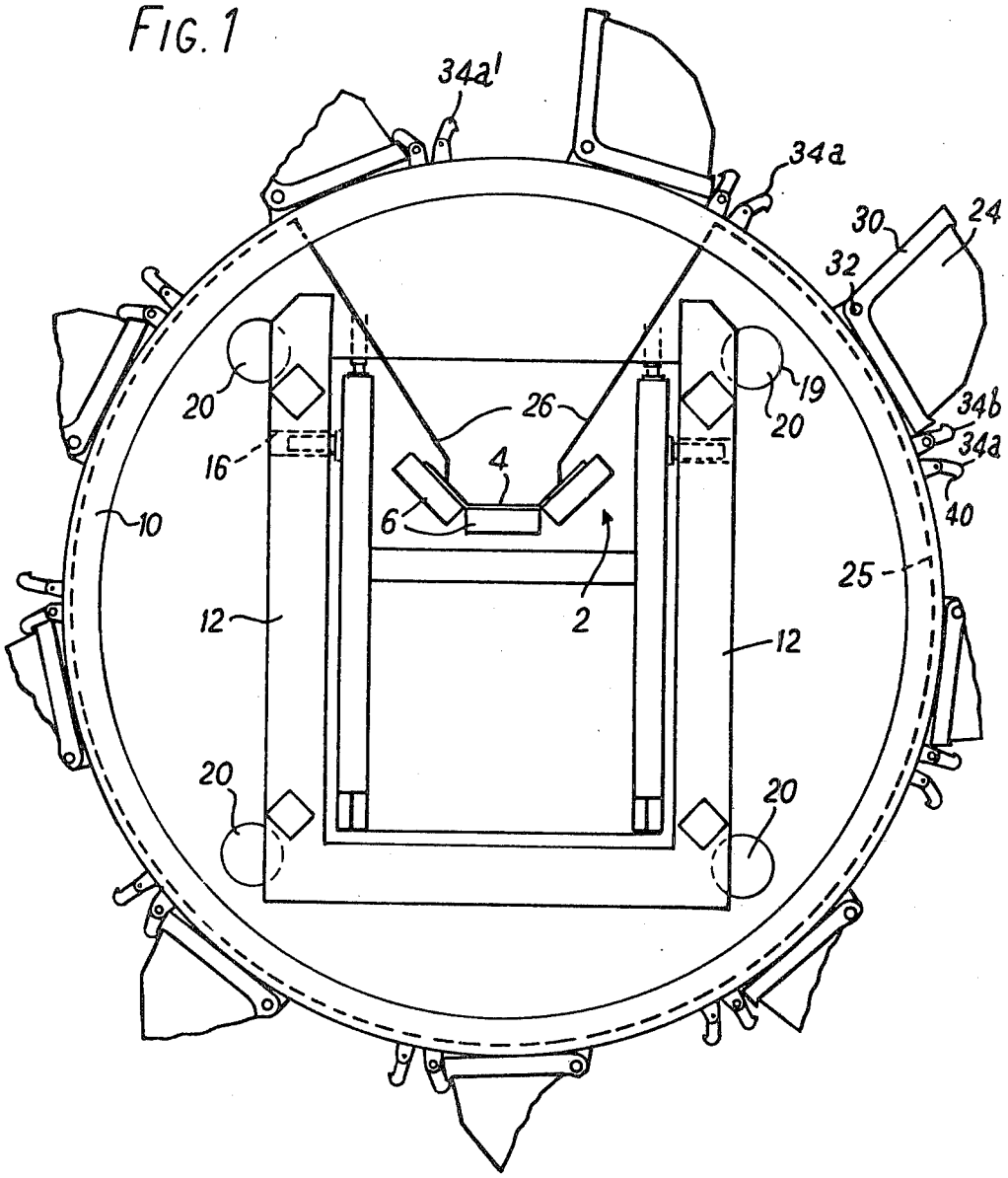
FIG. 1 is an end sectional view of a bucket wheel reclaimed on the line I—I in FIG. 3 illustrating a bucket wheel according to the invention.
Figure 2:
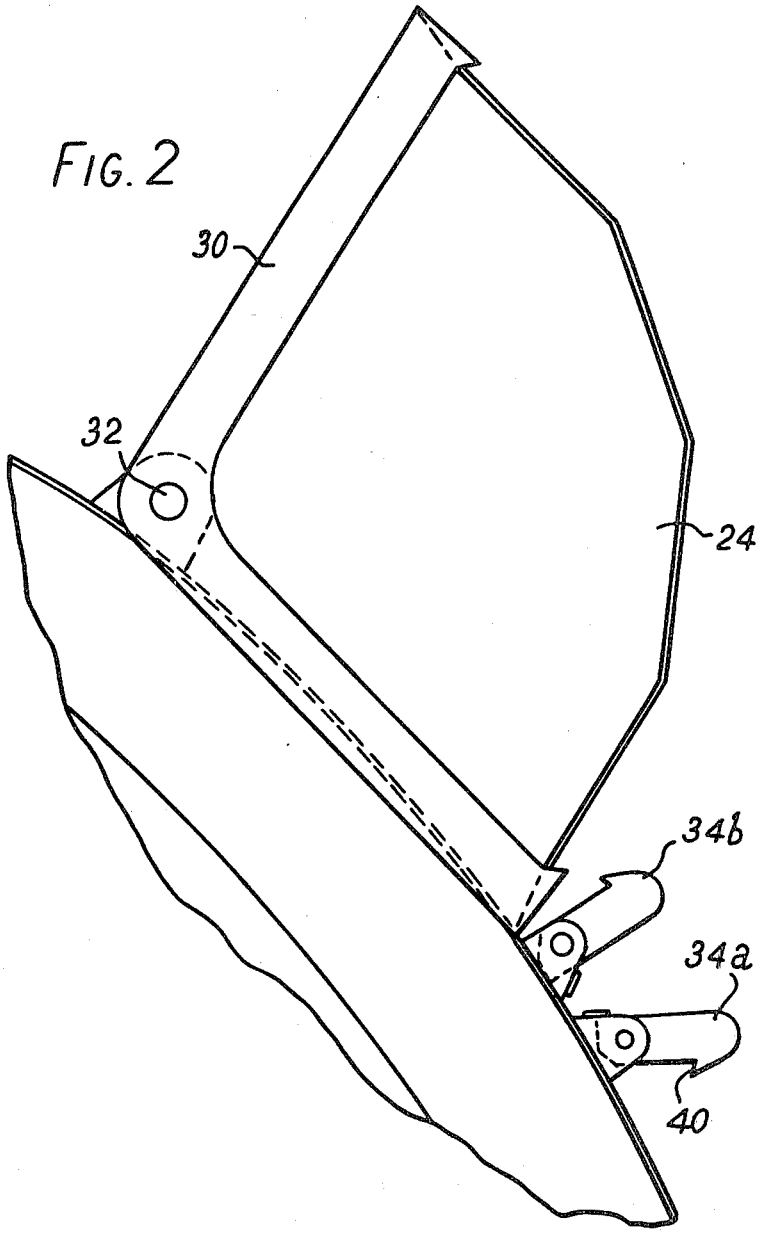
FIG. 2 illustrates a portion of the bucket wheel of FIG. 1 to a larger scale.
Figure 3:
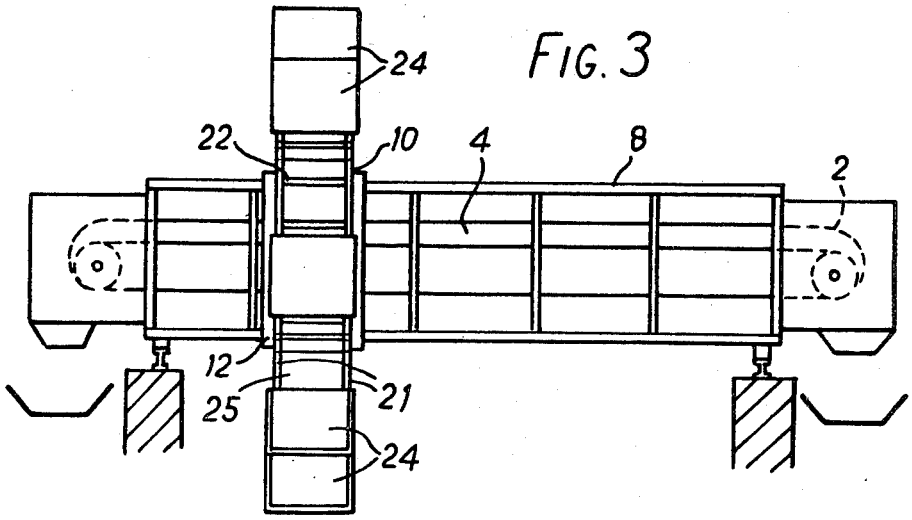
FIG. 3 is an outline side view of a bucket wheel reclaimer incorporating a bucket wheel according to the invention.

In FIGS. 1 to 3 of the drawings can be seen a belt conveyor 2 having its belt upper run 4 supported by troughing rollers 6 mounted on an elongate carriage 8 the ends of which are supported on rails 9 extending horizontally and parallel to the plane of the drawing. A bucket wheel 10 is mounted on the carriage 8 through a support frame 12 which engages support and guide rails 14, 16 on the carriage so that support frame with the bucket wheel is moveable in known manner by drive means along the length of the carriage, in the direction of the central axis of the bucket wheel. The bucket wheel is located on its support frame 12 by four rollers 20 so as to be roratable thereon about its central axis by one or more drive motors 19 on the support frame.

As in the case of a conventional bucket-wheel stockpile reclaimer, therefore, the bucket wheel can be progressed along the carriage as it rotates to deposit material onto the conveyor and the reclaimer can be advanced over the stockpile by moving the carriage on its rails.

The bucket wheel comprises two circular end rings 21 connected together by an open framework construction 22 and a series of buckets 24 are mounted at regular intervals on its outer periphery. It is faced on its inner periphery by an annular guide 25 fixed to the support mounting and extending round the inner periphery from near the bottom region of the wheel to a discharge chute 26 occupying approximately the top 60° of the wheel periphery. The annular guide forms an inner wall bounding parts of the bucket wheel inner periphery, so that the material picked up by the buckets as the wheel rotates is prevented by the non-rotating guide from falling from the buckets as they rise until they reach the chute, where the material is then discharged through onto the conveyor.

Each bucket is a symmetrical, generally U-form member having a reinforcing edge lipping 30. In its plane of symmetry at the ends of the free arms of that U-form it has pivots 32 by which it is secured to the bucket wheel outer periphery. It can thus swing on its pivot mounting between opposite end positions in which one or other side of its edge lipping bears against the outer periphery of the wheel and the bucket entry opening faces in one direction or the other, framed by the remaining side of the edge lipping. Each bucket is held in these end positions alternatively by respective gravity-operated latches 34*a*, 34*b* that can be designated leading and trailing latches respectively, depending on the direction of rotation of the bucket. In the illustrated positions, the leading latches have been indicated by the suffix a and the trailing latches by the suffix b, but they become the trailing and leading latches respectively when the direction of rotation of the bucket wheel is reversed. It will be noted that in either direction of rotation, the latches are disposed immediately behind an adjacent bucket wheel and are protected to some extent thereby from direct exposure to the stockpile material.

The latches are pivoted on lugs 36 on the bucket wheel periphery and the movement of each latch towards its associated bucket is limited by a stop 38. The projecting end of the latch has a hooked form 40 that can engage behind a shoulder 42 formed by the rear face of the bucket edge lipping to lock the bucket in an end position when the bucket and latch are pivoted towards each other.

The illustrated arrangement indicates the buckets in the end positions for anti-clockwise rotation of the bucket wheel. If the rotation of the wheel is reversed, in an automatic sequence the buckets swing about their pivots after disengagement of the previously engaged latches 34*b*, and the opposite latches 34*a* engage with the buckets in their new positions. By a completely analogous procedure, a changeover from clockwise rotation to anticlockwise rotation will release the latches 34*a* and bring the latches 34*b* into operation, but for simplicity the following description will be related to the changeover from the anticlockwise rotation positions illustrated.

As the drawing shows, the latches are not continuously in engagement with their buckets, whatever direction of rotation is adopted, and it is only necessary for them to retain the buckets in their operative end positions for a relatively small arc of movement in each revolution of the wheel. During the rising movement of a bucket, its trailing latch 34*b* previously holding it in position will swing downwards due to its own weight acting about its pivot 36, and so be out of engagement with the bucket, but the weight of the bucket and of any material in it are then acting to hold the bucket in the already established end position. During this rising movement the leading latch 34*a* will swing downwards also under its own weight, to the extent permitted by its stop 38, and conversely the trailing latch will adopt a position in which the bucket would be engaged if that were not prevented by its own weight from pivoting to the opposite end position. Over the major part of the rising movement of a bucket, therefore, neither latch engages the bucket.

When the rotation of the bucket wheel is reversed, the unlatched bucket is now descending and as it enters the bottom sector of its movement its weight causes it to pivot from the end position previously held as its centre of gravity moves to the other side of the vertical line through its pivot axis. The pivoting continues as the bucket enters its rising sector and the bucket reaches its opposite end position. As indicated above, it remains unlatched in the rising sector, but it is now completely out of the zone of action of the latch 34*b* that engaged it before reversal of the rotation but that is now its leading latch.

Each latch 34*a* previously leading before reversal of rotation, is now the trailing latch in the new direction of rotation. As it approaches the top of the wheel, the centre of gravity of each of these latches comes in front of its pivot and so the latch swing over as shown at 34*a'* (FIG. 1) at the top of the wheel, but because now the bucket (to the right of the latch 34*a'* in the figure) has repositioned itself to the opposite end position to that illustrated the latch engages the shoulder 42 of the bucket. The bucket is now locked in its new position. During the descending movement of the bucket its weight tends to swing it outwards about its pivot, but this is prevented by the engaged trailing latch.

To allow each latch to release freely from the adjacent shoulder of its bucket lip as it enters a rising sector, the hook-form of the latch has its operative face at an angle not greater than 90° to the radius from the latch pivot through it.

Although in the above description the rearrangement of the buckets and the engagement of their latches occurs solely by gravity bias, it is possible to provide automatic movements that are generated or assisted by other biasing means. For example, the latches may be spring biased, and they may comprise a bistable mechanism operated through trips mounted at fixed positions, e.g. on the annular guide. It is also possible to use trips to reposition the latches, e.g. in the form of cam tracks that may similarly be fixed to the annular guide. It may be preferred in some instances to use both biasing means and trip means.

Figure 4:
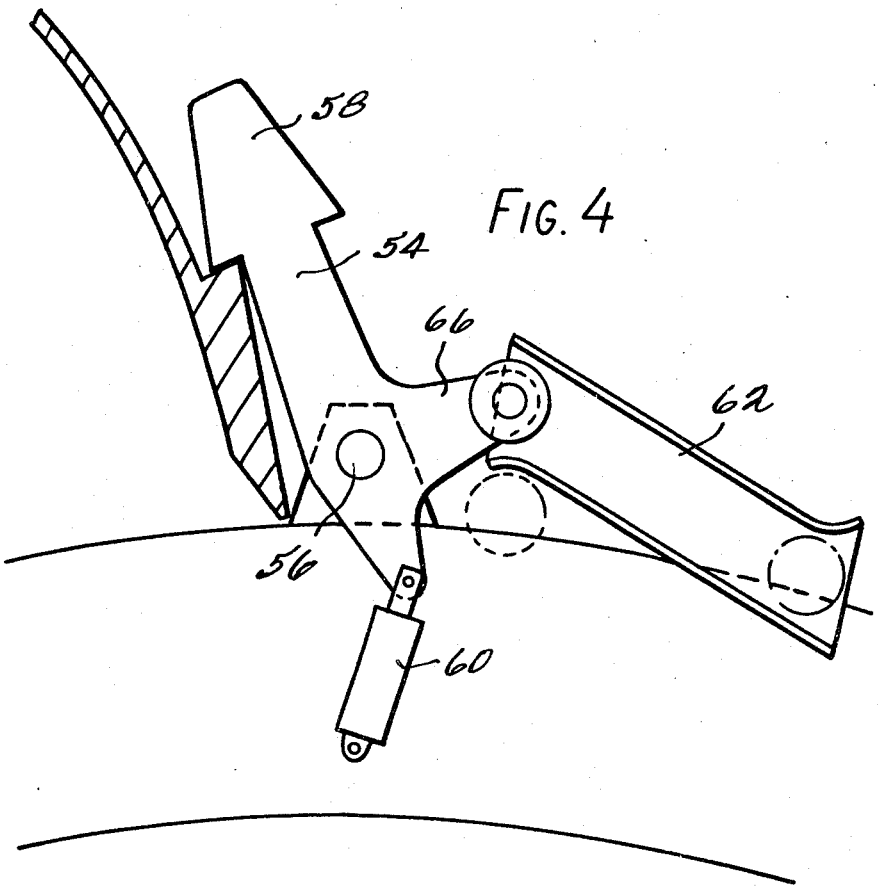
FIG. 4 is a detail view of alternative latching means and their means of operation.

FIG. 4 illustrates an arrangement in which there is a single common latch 54 mounted on a pivot 56 between adjacent pairs of buckets, instead of the pair of latches 34 of the first embodiment. The latch 54 has a double-hooked head 58 so that it can engage the bucket on either side of it. Although this embodiment is similar in other respects to that shown in FIGS. 1 to 3, the figure illustrates some of the modifications described above.

Thus, the latch 54 is held bistably by a tension spring 60 also mounted on the bucket wheel and a double-sided guide ramp 62 is mounted on the carriage 8 at a fixed angular position relative to the bucket wheel axis but is movable parallel to that axis to be displaced into and out of the paths of the rollers 64 on an integral limb 66 of each latch member.

The guide ramp can operate to switch the latch between its opposite end positions at an appropriate point in the rotational cycle of the bucket wheel when the rotation of the wheel is reversed.

Considering the position illustrated in FIG. 4, if the wheel is carrying the latch from left to right, the roller 64 will enter the guide ramp and the latch will be cammed clockwise on its pivot 56 to release it from the bucket lip and bring it to its oppositely biased position where it can engage the other of the two buckets as that other bucket is pivoted by its own weight to bring its lip against the latch. The buckets are able to deflect their latches as they swing under gravity on the pivots 32 and so "snap" into engagement with the latch. When all the buckets have been reversed, the ramp is moved laterally out of the path of the rollers until it is required to reverse the rotation of the wheel again: the ramp is then again brought to its operative position and the rollers 64 now travelling through the ramp in the opposite direction (right to left in FIG. 4) are displaced to switch the latches back to their illustrated positions.

It is also possible to employ a circumferentially extended form of ramp to hold the latches against the required buckets during the necessary part of the rotational cycle to provide the required effect, without needing a spring bias on the latches. It is also possible to employ ramps or other forms of trip that are also fixed transversely of the wheel and that switch over the latches at least twice in each rotational cycle so that they are always primed for the reversal of the bucket wheel when the buckets are released from the latches at an appropriate stage to allow them to make a snap engagement with the latches as they swing on their pivots 32 to their opposite positions.

It will be understood that the modifications described above can be employed singly or jointly in a construction otherwise arranged in the manner illustrated in FIGS. 1 to 3, and that many other modifications are possible within the scope of the invention.

What is claimed is:

1. A bucket wheel comprising:

a wheel structure including means on said structure for mounting the wheel for rotation about a central axis;

a series of buckets at the periphery of said structure;

respective pivot mounting means between the structure and the buckets for permitting pivotal movement of the buckets relative to the structure between first and second opposite end positions in which each bucket has an open entry facing in respective opposite directions peripherally of the wheel;

latching means on said structure for engaging and retaining the buckets in said first or second end positions in dependence upon the rotational direction of said wheel, said latching means being displaceable between engagement and release positions, said buckets being freely pivotable when released from the latching means to be displaceable between said first and second end positions, said latching means operating in response to reversal of the direction of rotation of said wheel so as to be sequentially displaced from said engagement position to said release position to permit said buckets to be sequentially pivotally moved from said first end position to said second end position and said latching means being sequentially displaced during continued rotation of said wheel in said reverse direction from said release position to said engagement position to retain said buckets in said second position, whereby the open entries of the buckets face in the direction of rotation of the wheel for either of said directions of rotation.

2. Bucket wheel according to claim 1 wherein said latching means comprise latch members mounted on the wheel structure to engage the bucket wheels at regions remote from their pivot mountings.

3. A bucket wheel according to claim 2 wherein the latch members comprise displaceable hooked elements and the bucket wheels are provided with external engagement faces for said hooked elements.

4. A bucket wheel according to claim 3 wherein each bucket wheel comprises a reinforcing lipping, a leading edge of the bucket wheel in each direction of rotation being formed by the lipping and said lipping also providing the engagement faces for the hooked elements of the latch members.

5. A bucket wheel according to claim 3 wherein pivot mountings are provided on the wheel structure for said latch elements and each hooked element has an operative face for engaging the associated bucket engagement face, and each said operative face is directed at an angle not greater than 90° to the radius from the axis of the associated latch member pivot mounting.

6. A bucket wheel according to claim 1 wherein the latching means are gravity operated.

7. A bucket wheel according to claim 1 comprising biasing spring means connected to the latching means.

8. A bucket wheel according to claim 1 wherein the latching means comprise a bistable mechanism and trip means fixed relative to the rotation of the bucket wheel to operate said mechanism at predetermined angular positions with respect to the axis of rotation of the bucket wheel.

9. A bucket wheel according to claim 1 comprising guide means fixed relative to the rotation of the bucket wheel for operation of the latching means.

10. A bucket wheel reclaimer comprising a carriage, guide means extending longitudinally on said carriage, a support means mounted on said guide means and displaceable therealong, rotational mounting means on said support means defining a rotary axis parallel to the guide means and a bucket wheel including a wheel structure mounted on said mounting means for rotation about said axis, said bucket wheel comprising:

a series of buckets at the periphery of said wheel structure;

respective pivot mounting means between the structure and the buckets for permitting pivotal movement of the buckets relative to the structure between first and second opposite end positions, said buckets being each independently pivotable on their mounting; and latching means on the wheel structure for latching the individual buckets in an operative one of said first or second end positions in dependence upon the direction of rotation of the bucket wheel, said latching means for sequentially unlatching said buckets in response to a reversal of the direction of rotation of said wheel to permit said buckets to sequentially move from said first end position to said second end position and for sequentially latching said buckets during continued rotation of said wheel in said reverse direction to retain said buckets in said second position.

11. A bucket wheel as in claim 10 wherein the latching means are gravity operated.

* * * * *